United States Patent [19]

Cueman et al.

[11] Patent Number: 4,979,199

[45] Date of Patent: Dec. 18, 1990

[54] MICROFOCUS X-RAY TUBE WITH OPTICAL SPOT SIZE SENSING MEANS

[75] Inventors: Michael K. Cueman, Niskayuna; Lewis J. Thomas, III, Schenectady; Casmir R. Trzaskos, Amsterdam, all of N.Y.; August D. Matula, Falmouth, Va.; Michael J. Austin, Albany, N.Y.

[73] Assignee: General Electric Company, Schenectady, N.Y.

[21] Appl. No.: 429,743

[22] Filed: Oct. 31, 1989

[51] Int. Cl.[5] ..... H01J 35/00; H01J 35/14

[52] U.S. Cl. ..... 378/121; 378/138; 378/207; 378/140

[58] Field of Search ..... 378/113, 109, 137, 138, 378/207, 121, 140

[56] References Cited

U.S. PATENT DOCUMENTS

| | | | |
|---|---|---|---|
| 2,340,363 | 2/1944 | Atlee et al. | 378/138 |
| 2,878,393 | 3/1959 | Graves | 378/138 |
| 4,400,823 | 8/1983 | Haendle | 378/113 |
| 4,426,722 | 1/1984 | Fujimura | 378/138 |
| 4,607,380 | 8/1986 | Oliver | 378/138 |
| 4,688,241 | 8/1987 | Peugeot | 378/137 |

*Primary Examiner*—Janice A. Howell

*Assistant Examiner*—Kim-Kwok Chu

*Attorney, Agent, or Firm*—Paul R. Webb, II; James C. Davis, Jr.

[57] ABSTRACT

A microfocus X-ray tube has an anode that emits X-rays and, a biproduct of its waste heat, visible and near infrared light. This invention uses the biproduct light to adjust and maintain the focus of the electron beam and enhance the performance of the X-ray tube as a point source of X-rays. Only the light is reflected by a mirror along a path in which a viewport is placed in the tube envelope. An sensor, e.g., a photodiode, or television camera, is placed in the path. A display means, e.g., a television display, meter, etc., can be connected to the sensing means to display the emitting spot of the anode or the amplitude of the emission. The focus of the X-ray tube is assured by observing the biproduct light and adjusting the electron beam to either minimize the size of the glowing spot or maximizing its apparent brightness. A method for use with an emitter of first and second types of radiation comprises reflecting only the second type of radiation, and sensing the reflected radiation. A microfocus X-ray tube features a mirror for reflecting light but not X-rays. A viewport such as quartz can be disposed in the path of the reflected light in the tube envelope.

39 Claims, 2 Drawing Sheets

MICROFOCUS X-RAY TUBE WITH OPTICAL SPOT SIZE SENSING MEANS

BACKGROUND OF THE INVENTION

The present invention relates to monitoring X-ray tubes, and more particularly, to monitoring position, intensity, and focussing of the emitting spot of a microfocus X-ray tube.

When examining industrial objects, e.g., composite structures for aircraft engines, etc., for flaws, it is desirable to be able to detect even very small flaws. For this reason, microfocus X-ray tubes, which have a means for focussing the electron beam impinging on the anode, are used as the radiation source for high resolution radiography of such objects. These tubes can produce sharp images of small flaws or features because they approximate a point source of X-rays. In particular, their X-ray emitting spot has a diameter of about 20 to 50 μm compared with a diameter of about 1 to 2 mm for a non-microfocus X-ray tube. The X-rays that penetrate the object are usually passed through a collimator in order to reject scattered X-rays and help define the inspected region. The collimated X-rays are then detected and the detected signal is usually applied to a computer so that tomography can be performed.

A constant intensity signal is required for computer tomography. In order to achieve this, the anode-cathode voltage difference of the tube is regulated so that constant energy X-rays are emitted, and thus the penetration of the X-rays into the object is a constant. Further, the anode current is sensed and applied to a control grid voltage determining circuit in order to keep said current, and thus the amount of the X-rays, a constant. However, high quality imaging also requires careful control of the position and size of the X-ray emitting spot on the anode. This has been done by viewing the displayed image of a system having a collimator. Then the focussing means is adjusted for greatest image intensity since in systems having a collimator, the focussing means adjustment providing the greatest image intensity also provides the sharpest image. Alternatively, for systems not having a collimator, a fluoroscope is used to obtain a displayed image, and then the focussing means is adjusted for sharpest image. Unfortunately, the first of these processes is not "real time" in that the apparatus cannot be imaging the indus-trial object when this process is performed since the data obtained will be invalid. This allows spot defocussing, caused by changes in tube geometry due to thermal deformation, to occur during imaging of the object. The second process is bulky and expensive.

It is therefore an object of the present invention to provide a "real time", compact, and inexpensive focussing and intensity adjustment apparatus and method for a microfocus X-ray tube.

It is another object to provide a microfocus X-ray tube for use in such an apparatus and method.

SUMMARY OF THE INVENTION

In brief, these and other objects are achieved by apparatus for use with a means for emitting first and second types of radiation comprising means, disposed proximate the emitting means, for reflecting only said second type of radiation along a path; and means, disposed in said path, for sensing the reflected radiation.

A method in accordance with the invention for use with an emitter of first and second types of radiation comprises reflecting only said second type of radiation; and sensing the reflected radiation.

A microfocus X-ray tube in accordance with the invention comprises a longitudinal envelope having first and second ends; a cathode means, disposed proximate said first end, for emitting electrons; a focussing means, disposed between said ends, for focussing the emitted electrons; an anode means, disposed at said second end for emitting X-rays, and visible and near infrared light in response to the impingement of said electrons; and a mirror means, disposed proximate said anode means, for reflecting only said visible and near infrared light along a path.

DETAILED DESCRIPTION

Figure 1:
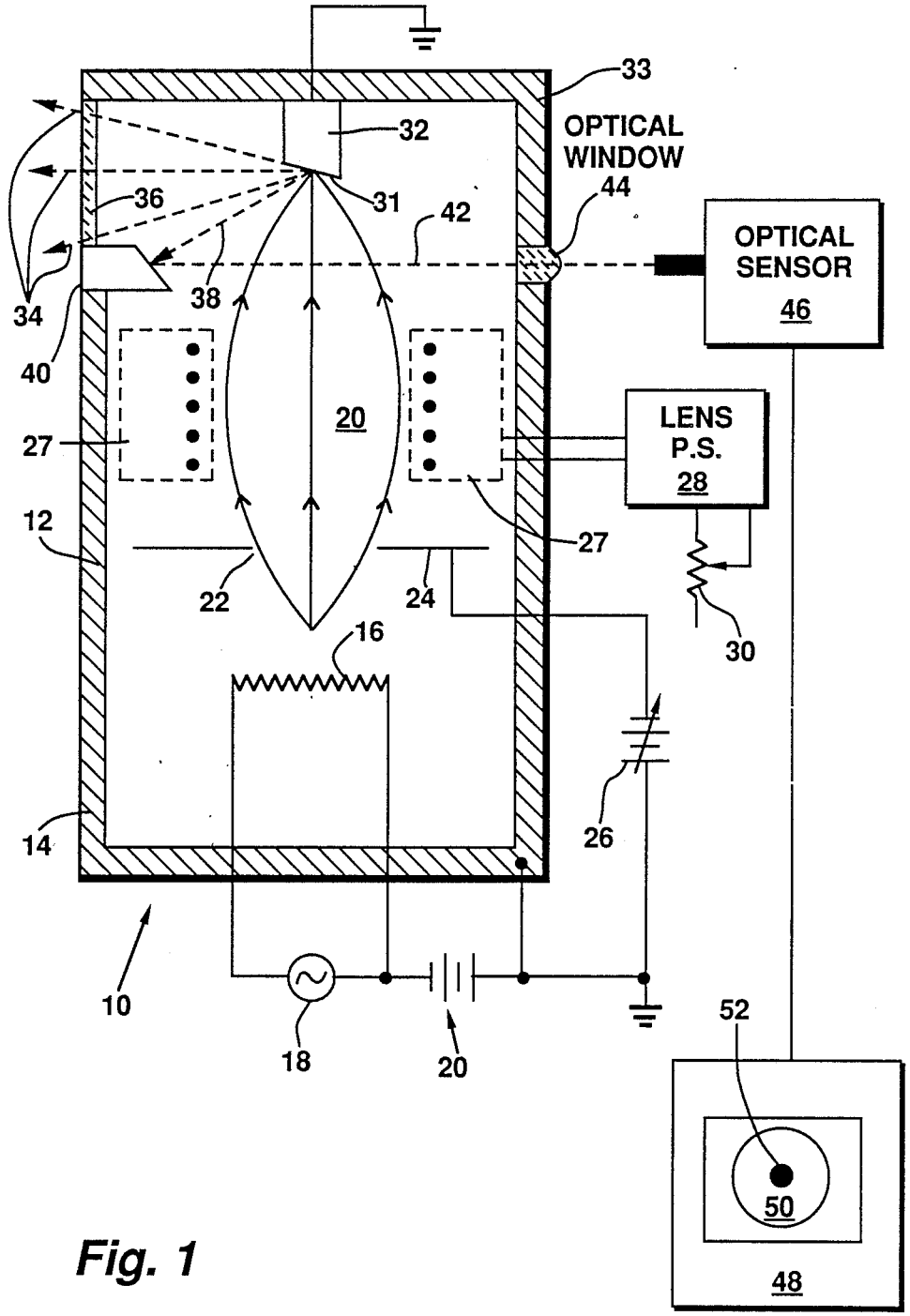
FIG. 1 is a partly schematic and partly block diagram of an embodiment of the invention.

FIG. 1 shows a microfocus X-ray tube, generally designated 10, having an envelope 12 typically made of grounded electrically conductive metal with sufficient strength and thickness to withstand a vacuum on the inside thereof and ambient pressure on the outside thereof. A high temperature glass with a grounded conductive interior coating, e.g., Al, can also be used. A grounded coating is used to provide a return path for stray electrons and for safety. Disposed at a first end 14 of envelope 12 is a cathode 16 coupled to an AC source 18, which typically supplies two to three volts at about one ampere to heat filament cathode 16 so that it will emit electrons. A DC supply could also be used for source 18. It will be understood that the leads connecting cathode 16 to source 18 are insulated from envelope 12 to prevent a short circuit, as are all other leads extending through envelope 12. The emitted electrons are provided by a DC source 20 having its positive lead grounded and its negative terminal connected to one of the leads of cathode 16. Source 20 typically provides about 160 KV at about 1 ma. Although cathode 16 is shown as a directly heated cathode, an indirectly heated one can be used; however, the electrons emitted from a directly heated cathode can be more tightly focussed.

The electron beam 20 emitted from cathode 16 passes through an aperture 22 of a control grid 24 disposed proximate cathode 16 and coupled to the negative terminal of DC source 26 having a grounded positive terminal. Source 26 provides about two to three KV and is adjustable so as to provide control of the anode-cathode current and thus the amount of X-rays. Next the electron beam goes through a focussing means or electron lens, e.g., a solenoidal coil 27 coupled to a DC lens power supply 28 that provides current to coil 26. The amount of current is determined by potentiometer 30, which therefore controls the focussing and spot size on the anode. Although an electromagnetic focussing means has been shown and described, an electrostatic focussing means can be used.

Electron beam 20 finally impinges upon a slanted face 31 of a grounded electrically conducting anode 32, which is disposed at a second end 33 of envelope 12. Anode 32 is preferably made of Tungsten (W), since it has a high atomic number and therefore a high electron cross-section and also a high melting point; however, other metals can be used. It will be appreciated that cathode 16 and the negative terminal of the source 20 can be grounded and the positive terminal of source 20 can be coupled to anode 32 without being grounded. However, the grounded anode configuration as shown in FIG. 1 and described above allows for easier replacement of anode 32.

A very small portion of the kinetic energy of beam 20 is converted into a first type of radiation, i.e., X-rays 34, which exit tube 10 by way of an X-ray window 36, which typically is made of Be or Al, etc. A very large portion of said energy is converted into heat and thus a second type of radiation, i.e., near infra-red and visible light. X-rays 34 are then incident upon an object (not shown) to be imaged. An X-ray detector (not shown), e.g., scintillator material coupled to a linear photodiode array, detects the X-rays that are transmitted through the object and provides a signal to a computer (not shown) to perform Tomography. Instead of using a photodiode array and a computer, a fluoroscope can be used.

In accordance with the invention, a mirror 40 having a light reflecting coating, e.g., Ag, Al, etc., is disposed proximate anode 32 on the inside of envelope 12 and an optical window 44 is disposed on an opposing side of envelope 12. A non-opposing configuration can also be used. A portion 38 of the second type of radiation is reflected by mirror 40 along a path 42. The X-rays incident on mirror 40 simply pass through it without being reflected. The second type of radiation exits tube 10 by way of a viewport or optical window 44 since it is transparent to the second type of radiation and is disposed in path 42. Window 44 is preferably made of quartz for good thermal stability; however, other materials, e.g., high temperature glass can be used. It will be appreciated that if envelope 12 is made of transparent glass having an interior con-ducting coating, then window 44 can simply comprise not having the coating on envelope 12 in the area where path 42 crosses envelope 12. Further, if envelope 12 is made of transparent glass without the coating, then a distinct window is not required since in effect the entire envelope is a window. Disposed in path 42 is an optical sensor 46 such as color or monochrome television camera, photodiode detector, linear CCD imager, etc. If a color television camera is used, its output signal is usually provided to a color television display 48 by which anode face 50 and emitting spot 52 can be observed.

Figure 2A:
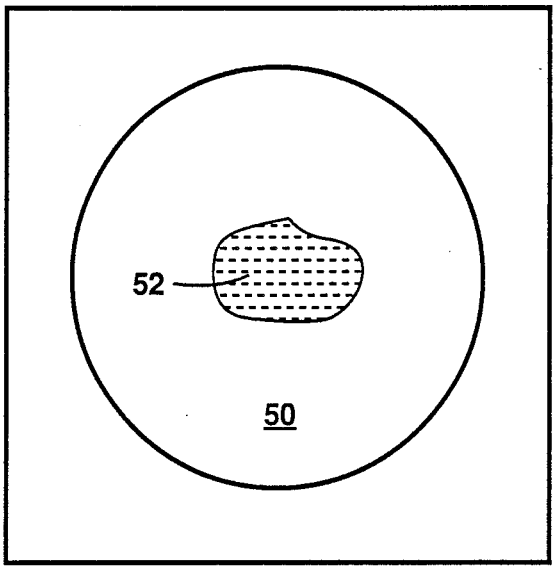
FIG. 2(*a–b*) is a diagram of a displayed image of an anode and its emitting spot.
Figure 2B:
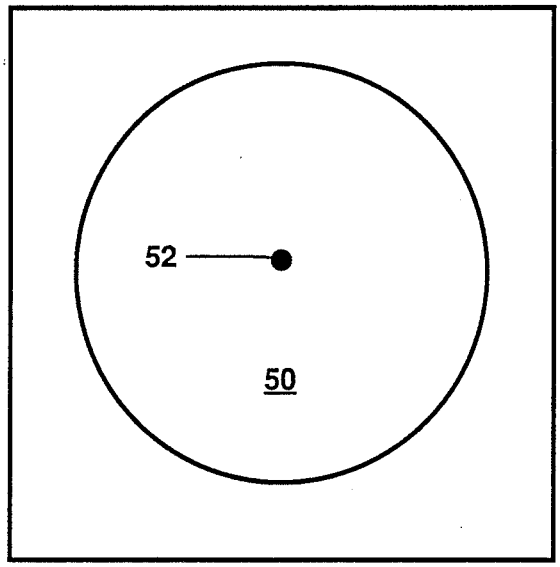

FIG. 2(*a*) shows that spot 52 of a poorly adjusted microfocus X-ray tube is typically is initially large, dim, and typically reddish in color. The electron beam 20 area is not tightly focussed. Since the visible spot 52 correlates with the X-ray emitting spot, emitted X-rays 34 will be poorly focussed and will not sharply image small details. During the imaging of the industrial object, the operator will then iterate adjustments of potentiometer 30 and the voltage from source 26 until the display looks like that of FIG. 2(*b*), wherein spot 52 is small, bright, and blue-white in color. This adjustment concentrates electron beam 20 into a small area of anode 32. Thus emitted X-rays 34 will now be sharply focussed and suitable for high resolution inspection. If either camera 46 or display 48 is a monochrome unit, then the above described adjustment process is performed to achieve the smallest spot size. If optical sensor 46 is a linear CCD array or a photodiode, then display 48 can comprise a meter to indicate signal amplitude and the above described adjustment process is performed to achieve the largest signal amplitude. If desired, a feedback circuit can be used to automate this process. If sensor 46 comprises a television camera and display 48 comprises a television display, spot position and anode damage can be monitored and corrected by adjust-ment of an electromagnetic or electrostatic deflection system (not shown) to select another impact point on surface 31. Eventually anode 32 will require replace-ment. Also, the present invention can monitor for emission instabilities and provide a correction signal to the computer (if used) so that the data obtained will be valid.

It will therefore be appreciated that the present invention provides real time, compact, and inexpensive monitoring and adjustment of a microfocus X-ray tube.

What is claimed is:

1. Apparatus for use with a means for emitting first and second types of radiation, said apparatus comprising:

means, disposed proximate the emitting means, for reflecting only said second type of radiation along a path; and means, disposed in said path, for sensing the reflected radiation.

2. The apparatus of claim 1 further comprising said emitting means, said emitting means comprising an X-ray tube having an anode.

3. The apparatus of claim 2 wherein said tube further comprises a viewport disposed in said path.

4. The apparatus of claim 1 wherein said reflecting means comprises a mirror.

5. The apparatus of claim 1 wherein said first type of radiation comprises X-rays and said second type of radiation comprises visible and near infrared light.

6. The apparatus of claim 1 wherein said sensing means comprises a photodiode.

7. The apparatus of claim 1 wherein said sensing means comprises a television camera.

8. The apparatus as claimed in claim 1 further comprising a display means coupled to said sensing means.

9. Apparatus for use with a microfocus X-ray tube having an anode means for emitting X-rays, and visible and near infrared light, when subject to impinging electrons, said apparatus comprising:

a mirror means, disposed proximate the anode, for reflecting only the visible and the near infrared light along a path; and means, disposed in said path, for sensing the reflected visible and near infrared light.

10. The apparatus of claim 9, wherein said tube has an envelope, said envelope having a viewport disposed in said path.

11. The apparatus of claim 10, wherein said mirror means and said viewport are in opposing relationship.

12. The apparatus of claim 10 wherein said viewport comprises quartz.

13. The apparatus of claim 9 wherein said mirror is silvered.

14. The apparatus of claim 9 wherein said sensing means comprises a photodiode.

15. The apparatus of claim 9 wherein said sensing means comprises a television camera.

16. The apparatus of claim 15 wherein said camera comprises a color camera.

17. The apparatus of claim 15 wherein said sensing means comprises a CCD imager.

18. The apparatus of claim 1 further comprising a display means coupled to said sensing means.

19. The apparatus of claim 18 wherein said display means comprises a television display.

20. The apparatus of claim 19 wherein said display comprises a color display.

21. The apparatus of claim 9 wherein said tube has a control grid and a focussing means, and said apparatus further comprises means for adjusting the focussing and intensity of the emitted X-rays.

22. The apparatus of claim 21 wherein said adjusting means comprises a variable voltage power supply adapted to be coupled to the grid, and a variable current power supply adapted to be coupled to the focussing means.

23. A method for use with an emitter of first and second types of radiation, said method comprising:

reflecting only said second type of radiation; and sensing the reflected radiation.

24. The method of claim 23 wherein said first type of radiation comprises X-rays and said second type of radiation comprises visible and near infrared light.

25. The method of claim 23 wherein said sensing step comprises imaging.

26. The method of claim 25 wherein said imaging step comprises color imaging.

27. The method of claim 23 further comprising displaying the sensed radiation.

28. The method of claim 27 wherein said displaying step comprises displaying in color.

29. The method of claim 23 further comprising adjusting the emitter.

30. The method of claim 29 wherein said adjusting step comprises adjusting intensity and focus of the emitter.

31. A microfocus X-ray tube comprising:

a longitudinal envelope having first and second ends;

a cathode means, disposed proximate said first end, for emitting electrons;

a focussing means, disposed between said ends, for focussing the emitted electrons;

an anode means, disposed at said second end for emitting X-rays, and visible and near infrared light in response to the impingement of said electrons; and a mirror means, disposed proximate said anode means, for reflecting only said visible and near infrared light along a path.

32. The tube of claim 31 wherein said cathode means comprises a directly heated cathode.

33. The tube of claim 31 wherein said focussing means comprises a coil.

34. The tube of claim 31 wherein said anode comprises tungsten.

35. The tube of claim 31 wherein said mirror means comprises a silvered mirror.

36. The tube of claim 31 further comprising a viewport disposed in said envelope in said path.

37. The tube of claim 36 wherein said viewport comprises quartz.

38. The tube of claim 36 wherein said viewport and said mirror means are in opposing relationship.

39. The tube of claim 31 further comprising a control grid disposed between said cathode means and said electron lens means.

* * * * *